US007049810B1

(12) United States Patent
Stava

(10) Patent No.: US 7,049,810 B1
(45) Date of Patent: May 23, 2006

(54) APPARATUS TO MEASURE FILL

(75) Inventor: Elliott K. Stava, Sagamore Hills, OH (US)

(73) Assignee: Lincoln Global, Inc., Monterey Park, CA (US)

( * ) Notice: Subject to any disclaimer, the term of this patent is extended or adjusted under 35 U.S.C. 154(b) by 342 days.

(21) Appl. No.: 10/621,721

(22) Filed: Jul. 18, 2003

(51) Int. Cl.
*G01R 27/72* (2006.01)
*G01R 33/12* (2006.01)

(52) U.S. Cl. ..... 324/239; 324/229; 324/240

(58) Field of Classification Search ..... 324/228, 324/229, 230, 231, 239, 234, 235, 240, 207.17, 324/207.18, 207.19; 234/40
See application file for complete search history.

(56) References Cited

U.S. PATENT DOCUMENTS 1,632,076 A * 6/1927 Hubbard ..... 324/229
1,815,717 A * 7/1931 Kranz ..... 324/229
2,920,269 A * 1/1960 Hanysz et al. ..... 324/230
3,466,907 A 9/1969 Landis
4,555,665 A * 11/1985 Stanley et al. ..... 324/229
4,593,244 A * 6/1986 Summers et al. ..... 324/230
5,057,781 A * 10/1991 Atkins et al. ..... 324/635
5,059,902 A * 10/1991 Linder ..... 324/207.17
5,091,696 A * 2/1992 Roosen ..... 324/229
5,142,228 A * 8/1992 Kingsbury ..... 324/230
5,729,135 A * 3/1998 Kugai ..... 324/240
5,963,030 A * 10/1999 Stark ..... 324/229
6,661,224 B1 * 12/2003 Linder ..... 324/227
6,844,722 B1 * 1/2005 Migliori et al. ..... 324/207.19

OTHER PUBLICATIONS

Data Sheet for NE/SA5521 rom Philips Semiconductors—dated Nov. 5, 2002.

* cited by examiner

*Primary Examiner*—Bot Ledynh
*Assistant Examiner*—Kenneth Whittington
(74) *Attorney, Agent, or Firm*—Fay, Sharpe, Fagan, Minnich & McKee, LLP

(57) ABSTRACT

An apparatus for indicating the wall thickness of a cored welding wire traveling in a given path to determine the percentage of volume of fill. This apparatus comprises a first induction coil surrounding the path; a source of AC current connected across the coil; a second reference coil connected to the AC source where the second reference coil surrounds a fixed section of cored welding wire with a desired wall thickness, and an output device indicating deviation of the wall thickness of the traveling wire from the wall thickness of the fixed section of wire by detecting the inductive reactance of the first coil compared to the second coil.

39 Claims, 3 Drawing Sheets

APPARATUS TO MEASURE FILL

The present invention relates to the art of electric arc welding and more particularly to an apparatus for indicating the percentage of fill of a cored welding wire in the production of such wire.

INCORPORATION BY REFERENCE

The present invention relates to the concept of determining the percentage or volume of fill by measuring the wall thickness of a moving cored welding wire as it is being manufactured. To describe the procedure for producing cored welding wire Landis U.S. Pat. No. 3,466,907 is incorporated by reference. This background information relates to the process which is monitored by the apparatus of the present invention. In the preferred embodiment of the invention two signals are compared in a linear variable differential transformer referred to as a LVDT signal conditioner. A data sheet from Philips Semiconductors dated Nov. 5, 2002 and providing the specification for the NE/SA 5521 LVDT is incorporated by reference as background information. Details of the operation of this particular type of signal conditioner is not required for understanding the present invention, since a variety of signal comparators could be employed for this purpose.

BACKGROUND OF INVENTION

Electric arc welding is often performed with a continuous welding wire including an outer metal sheath of low carbon steel and a core formed of flux material. The flux is not magnetic and is used to form a barrier over the weld bead to prevent atmospheric contamination during the welding and an inferior weld bead. To provide uniform welding, the percentage of core material, or "fill", to metal in the sheath is held constant along the total length of the welding wire. However, as shown in Landis U.S. Pat. No. 3,466,907 the sheath is wrapped around the fill and then the cored electrode is drawn through sizing dies to manufacture a welding wire having a specific outer diameter. It has been found that the core material is not uniformly distributed into the arcuate shaped sheath prior to its being wrapped into a tube. Consequently, as the tube is drawn through a die having a fixed diameter the internal volume of core material controls the thickness of the outer sheath. A large volume of non-magnetic core material results in a relatively thin sheath, whereas a low volume of fill produces a relatively thick sheath during the drawing process that reduces the diameter of the sheath to the desired wire diameter. Thus, the thickness of the sheath varies with the volume of fill. The percentage of fill to metal is determined by the volume of core material. To effect a uniform, high quality weld, the percentage of fill must be held relatively constant. Heretofore, there has been no apparatus or procedure to indicate unacceptable variations in the volume of internal core material. This is a disadvantage experienced in manufacturing cored welding wire, since the fill volume is inversely proportional to the wall thickness.

THE INVENTION

The present invention relates to an apparatus and method for indicating variations of the volume of core material from the desired volume, i.e. the percentage of fill. This objective is accomplished by sensing the wall thickness, which dimension is a corollary to the size of the internal core or fill.

In accordance with the present invention there is provided an apparatus for indicating a physical characteristic along the length of a welding wire traveling in a given path. In the preferred embodiment, this physical characteristic is the wall thickness of the metal sheath in a cored welding wire. This thickness is controlled by the volume of the core material and is indicative of the percentage of fill, which must be held within limits. The novel apparatus comprises an induction coil surrounding the path along which the welding wire is traveling, a source of AC current connected across the coil, a first circuit to measure the inductive reactance of the coil, a second circuit to compare the measured inductive reactance of the coil with the reference inductive reactance, and an output device responsive to the difference between the measured inductive reactance and the reference inductive reactance to indicate the magnitude of the physical characteristics. This characteristic, in the preferred embodiment, is the wall thickness of the sheath and in an alternative, the diameter of a solid metal wire.

In accordance with another aspect of the invention, the reference inductive reactance is the inductive reactance across a reference coil having a selected reference core fixed in the coil. In practice, the reference coil is provided with a cored electrode having the desired amount of fill and, thus, the desired wall thickness of the sheath. This segment of welding wire in the reference coil produces an inductive reactance for the coil, which reactance is used as a reference. The inductive reactance of the measuring coil varies as the monitored welding wire passes through the first coil. The two coils have the same length, generally less than 6 inches, and the same number of turns, so the inductive reactance of the reference coil can be compared to the inductive reactance of the measuring coil as the wire passes through the measuring coil. The inductive reactance of the measuring coil changes according to the amount of metal in the coil, which is indicative of the wall thickness of the wire and the percentage of fill. By comparing the difference in inductive reactance, the output device indicates if the wire passing through the measuring coil has the desired wall thickness and, thus, internal volume of core material. In practice, the output device actually reads deviation of the inductive reactance from the reference inductive reactance to determine the proportional size of the wall thickness around the core material and, thus, the percentage of fill.

The primary object of the present invention is the provision of an apparatus for indicating the percentage of fill material along the length of a cored welding wire.

Still a further object of the present invention is the provision of an apparatus, as defined above, which apparatus utilizes the inductive reactance of a measuring coil surrounding the cored welding wire passes continuously in the manufacturing process. The coil monitors the amount of internal fill material by sensing the thickness of the surrounding metal sheath.

Another object of the present invention is the provision of a method for measuring deviation of the wall thickness of a cored welding wire moving along a given path from a desired wall thickness, which deviation is indicative of the volume of core material in the welding wire and, thus, the percentage of fill.

Yet another object of the present invention is the provision of a method, as defined above, which method utilizes a measuring coil having an inductive reactance indicative of the amount of core material so that this inductive reactance can be compared with a reference inductive reactance to determine variation from the desired amount of fill material.

These and other objects and advantages will become apparent from the following description taken together with the accompanying drawings.

PREFERRED EMBODIMENT

Figure 1:
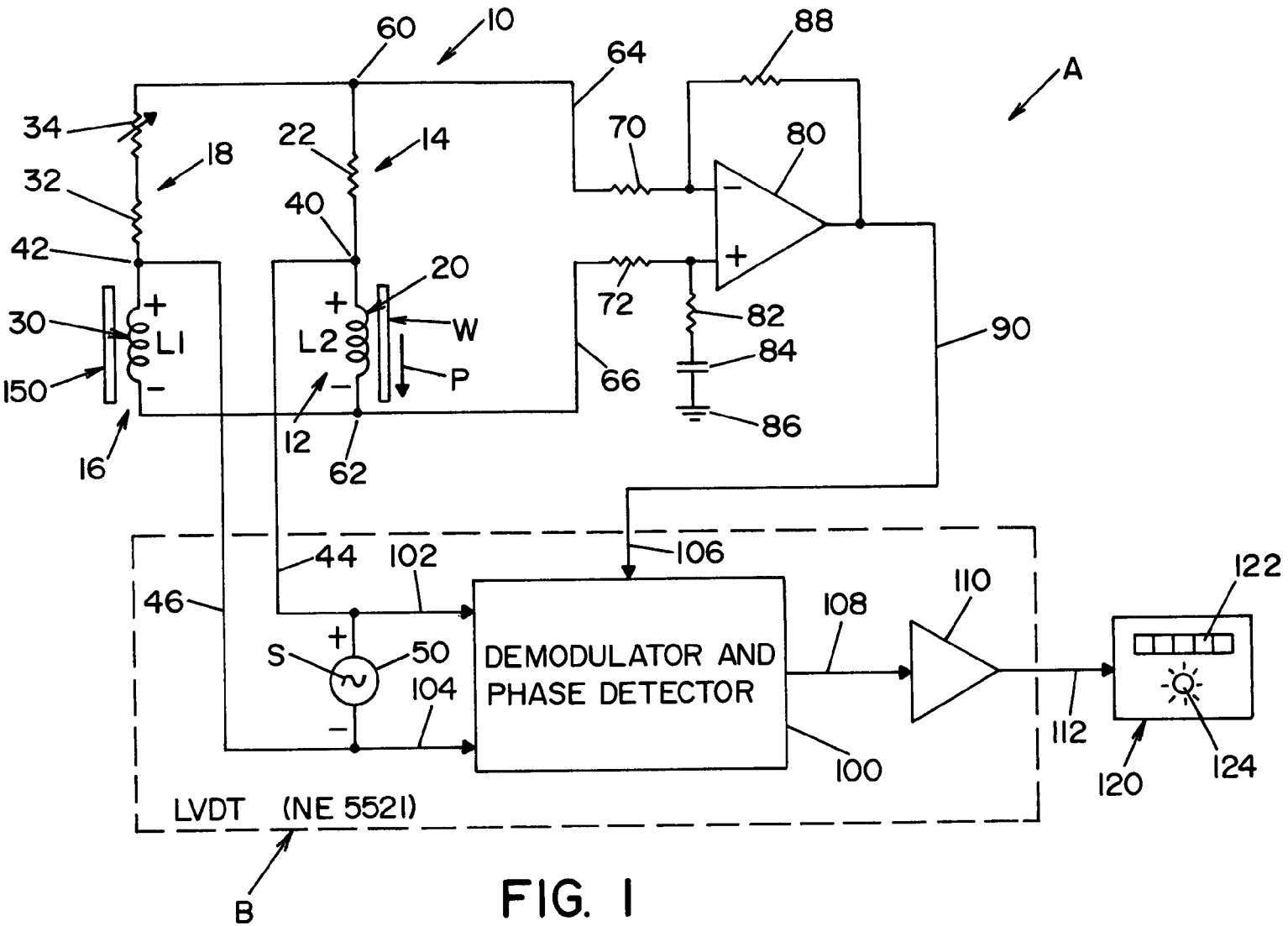
FIG. 1 is a wiring diagram and schematic illustration of the preferred embodiment of the present invention.
Figure 2:
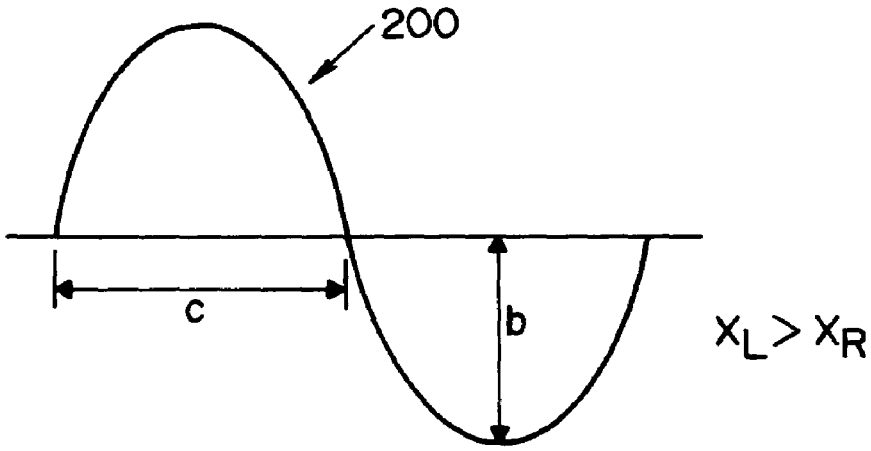
FIG. 2 is a graph illustrating a voltage signal when the wall thickness deviates from the desired wall thickness by a large amount.
Figure 3:
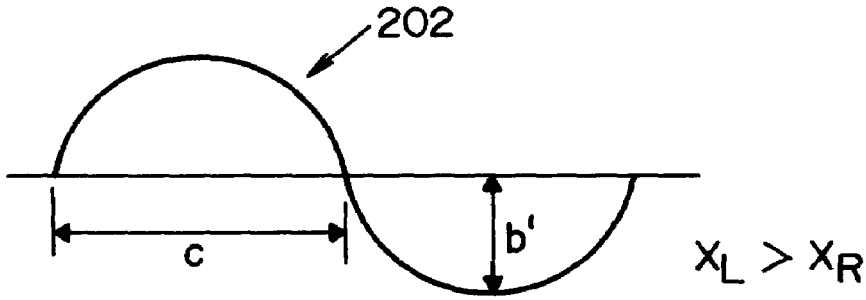
FIG. 3 is a view similar to FIG. 2 when the amount of deviation is a low amount.
Figure 4:
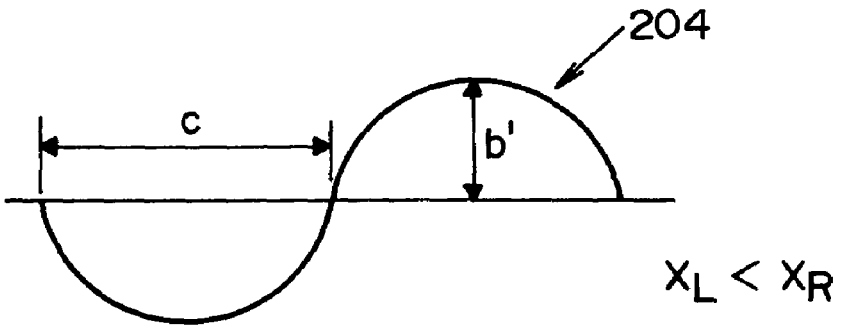
FIG. 4 is a view similar to FIGS. 2 and 3 when the deviation is a relatively low amount, but in the opposite direction from the examples illustrated in FIGS. 2 and 3.
Figure 5:
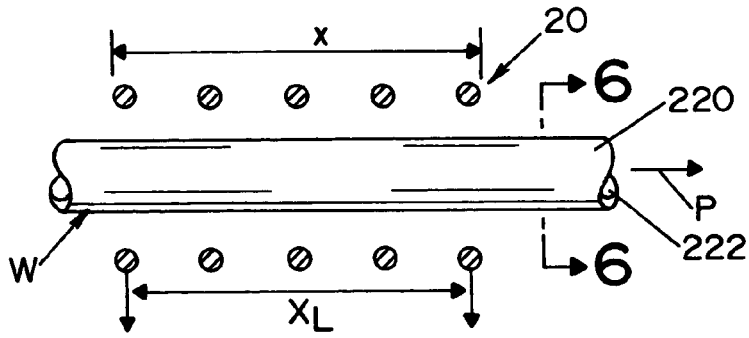
FIG. 5 is a cross-sectional view of the measuring coil used in accordance with the preferred embodiment of the present invention.
Figure 7:
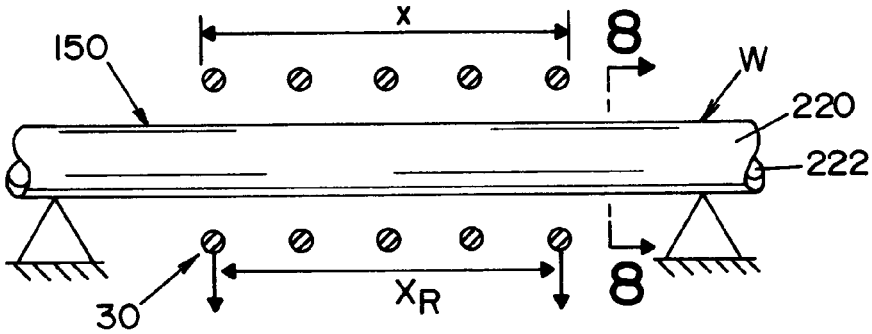
FIG. 7 is a cross-sectional view of the reference coil used in the preferred embodiment of the present invention.

Referring now to the drawings wherein the showings are for the purpose of illustrating a preferred embodiment of the invention only and not for the purpose of limiting same, FIG. 1 illustrates apparatus A having a balancing bridge 10, like a wheatstone bridge, with branches 12, 14, 16 and 18. In branch 12, an induction measuring coil 20 having a give number of turns and a length x, as shown in FIG. 5, constitutes the impedance of this branch. In practice, the length is less than 6.0 inches. In a like manner, resistor 22 constitutes the impedance of branch 14 connected in series with branch 12. On the opposite side of bridge 10, reference induction coil 30 has the same number of turns as coil 20 and the same length x. This branch is connected in series with branch 18 comprises a resistor 32 generally the same as resistor 22 and an adjustable resistor 34 for zeroing the output of bridge 10 when coils 20, 30 are loaded. The input of the bridge is an AC current at nodes 40, 42 from leads 44, 46 across which a sine wave signal S is provided by generator 50 within LVDT, designated as the IC circuit B circumscribed by dashed lines. Bridge 10 has output nodes 60, 62 connected by leads 64, 66, respectively, to amplifier 80 through current limiting resistors 70, 72. Amplifier 80 is a standard operational amplifier to transmit the sine wave voltage signal between nodes 60, 62. The amplifier is illustrated with a positive input connected through resistor 82 and capacitor 84 to ground 86. The gain of amplifier 80 is controlled by the resistor 88 so that the signal in output line 90 is a sine wave, as shown in FIGS. 2–4 and is directed to the demodulator and phase detector 100 of LVDT. In practice the LVDT is a chip sold by Philips Semiconductors as part number NE 5521. Demodulator and phase detector 100 has inputs 102, 104 from generator 50 whereby the sine wave signal S which drives nodes 40, 42 is a synchronization input to the demodulator. The other input is the sine wave on line 90 at terminal 106, so output 108 includes a magnitude signal passed through filter 110 to output line 112. The magnitude on line 112 is either digital or analog between a maximum and minimum, normally 0–10. This data is transmitted to output device 120 illustrated as having a visual display 122 and an alarm 124 in the form using light or sound. Since the signal on line 112 is calibrated between 0–10, the midpoint 5 is the desired output for apparatus A. Device 120 is set so alarm 124 signals a deviation of a given amount from the midpoint of the calibrated output on line 112. This signal indicates the comparison of the measured inductive reactance of coil 20 and the reference inductive reactance of coil 30. Apparatus A is used to determine the amount of core fill in electric welding wire W traveling in a path P through the center of coil 20. To provide a desired inductive reactance for comparison to the physical condition of moving wire W, coil 30 has a fixed internal core 150 having the desired physical characteristics for wire W. To set up apparatus A for the purpose of determining the percentage of fill in a cored wire W, core 150 is a length of the desired cored wire. This piece of wire is fixed in coil 30, as shown in FIG. 7. At the same time, a similar section of the wire having the desired percentage fill is placed within coil 20. With these two sections being the same, resistor 34 is adjusted to produce a 0 output at nodes 60, 62. After a calibration procedure, wire W from sizing die of the processing line is passed through coil 20 along path P. The output sine wave or voltage signal in line 90 is indicative of the relationship between the measured inductive reactance of coil 20 and the reference inductive reactance of coil 30. If the core is the desired fill volume, the thickness of the metal in its outer sheath will be the desired value. This produces a 0 output in lines 64, 66 and a midpoint desired signal in line 112. In practice, the midpoint reading is 5.

If the volume of the fill is too large, a high amplitude voltage signal, such as signal 200 in FIG. 2 is created. The signal has a period 2×c and an amplitude b. The signal has a positive polarity, indicating that the measured inductive reactance deviates greatly from the reference inductive reactance. This signal means the measured inductance is too high as compared with the reference inductive reactance or too low with respect to the inductive reactance of the reference. The deviation is high in FIG. 2. As the volume of fill material changes toward the desired amount, the magnitude, or amplitude, b is reduced, as shown by voltage signal 202 in FIG. 3. The magnitude b' is moving toward 0 which is the desired inductive reactance for the desired amount of fill and, thus, the desired thickness of the surrounding metal sheath. As the fill continues to change beyond the desired amount in the opposite direction of deviation, the signal on line 90 changes polarity, as indicated by signal 204 in FIG. 4. This polarity indicates that the inductive reactance of moving the wire W is substantially less than the inductive reactance of the reference coil 30 so the fill is in the opposite direction of deviation from the desired amount. Inductive reactance of coil 20, thus, indicates the wall thickness. When the wall thickness is at the desired level, the fill percentage is at the desired amount and there is no output signal at nodes 60, 62. Such signals from amplifier 80 as represented as signals 200, 202 and 204 in FIGS. 2–4 are directed to demodulator 100. The input signal S on lines 102, 104 is compared to the signal on line 90 to produce a gradient output in line 108. In practice, with a 0 signal in line 90, the output on line 112 is an intermediate number or level, such as 5. As the magnitude or amplitude of the signal on line 90 increases indicating either a deviation above the desired level or below the desired level, the number or level on line 112 increases or decreases. This is read by device 120 in visual display 122. If the deviation exceeds a certain amount, alarm 124 is activated.

Figure 6A:
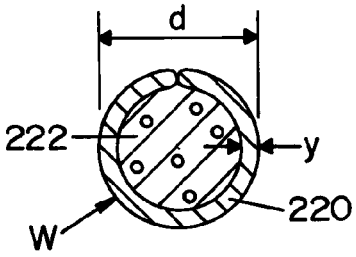
FIG. 6A is a cross-sectional view taken generally along line 6—6 when the amount of fill is at the desired level.
Figure 6B:
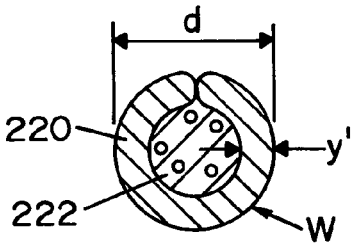
FIG. 6B is a view taken generally along line 6—6 of FIG. 5 when the amount of fill is below the desired amount.
Figure 6C:
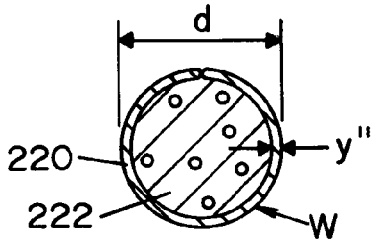
FIG. 6C is a view taken generally along line 6—6 of FIG. 5 when the fill amount of fill is greater than the desired amount.
Figure 8A:
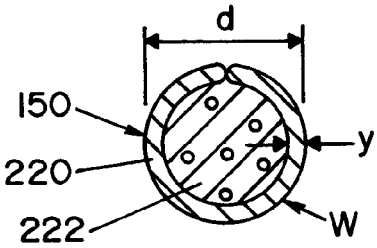
FIG. 8A is a cross-sectional view taken generally along line 8—8 of FIG. 7 representing a coil with the desired fill, as shown in FIG. 6A; and, FIG. 8B is a cross-sectional view taken generally along line 8—8 of FIG. 7 when the invention is used to measure the diameter of a moving welding wire.

As shown in FIG. 5, wire W moving through coil 20 produces an inductive reactance XL which varies according to the amount of fill 222 in sheath 220. The desired amount of fill for a given diameter d of wire W produces a desired percentage of fill and is shown in FIG. 6A. This fill creates a wall thickness y for sheath 220. With this wall thickness and percentage fill of core material 222, no signal is created between node 60 and node 62 as wire W passes through coil 20. If the amount of fill is decreased, as shown in FIG. 6B, the wall thickness is increased as indicated by y'. In a like manner, if the fill of core material 222 is increased, wall thickness y" is decreased in FIG. 6C. The wall thickness determines the inductive reactance of coil 20 having a length x as shown in FIG. 5. In practice the length is less than 6 inches. To provide a reference inductive reactance, the desired volume of fill as shown in FIG. 8A in a core 150 in the form of a piece of wire W is placed in reference coil 30 having the same number of turns and the same length x as the measuring coil 20. The desired physical characteristics of wire W as shown in FIGS. 6A, 8A, produces a reference inductive reactance XR for coil 30. If the inductive reactance for the reference coil is the same as the inductive reactance for the measuring coil, no signal appears in line 90. As the core material decreases or increases as shown in FIGS. 6B, 6C, respectively, the inductive reactance of coil 20 changes with respect to the reference inductive reactance to produce signals as discussed in FIGS. 2–4 for the purpose of creating a magnitude level along a gradient appearing in line 112 of apparatus A.

Figure 8B:
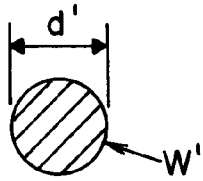

A modification of the present invention is possible by changing core 150 into a wire W', as shown in FIG. 8B. This is a solid welding wire with a diameter d'. By putting a section of this wire in coil 30, a solid wire W' is used to balance coil 20. Thereafter, as the solid wire W' moves through the coil, the signal in line 112 is indicative of the relationship of the actual diameter for wire W' compared to the desired diameter d'. Thus, apparatus A is used to measure the diameter of the welding wire coming from the drawing die. As the die wears over time, the diameter increases. The output on line 112 produces a digital number or analog level that is indicative of this deviation in wire diameter and is used to control the drawing die of the apparatus for producing solid welding wire. Thus, apparatus A can be used in processing cored welding wire as well as solid welding wire.

What is claimed is:

1. An apparatus for indicating a physical characteristic along the length of a welding wire traveling in a given path, said apparatus comprising: an induction coil surrounding said path; a source of AC current connected across said coil, a first circuit to measure the inductive reactance of said coil; a second circuit to compare said measured inductive reactance with a reference inductive reactance; and, an output device responsive to a difference between said measured inductive reactance and said reference inductive reactance to indicate the magnitude of said physical characteristic; wherein said welding wire is a cored or solid welding wire.

2. An apparatus as defined in claim 1 wherein said reference inductive reactance is the inductive reactance across a reference coil with a selected reference core fixed in said reference coil.

3. An apparatus as defined in claim 1 wherein said output device has a visual mechanism to display said magnitude of said physical characteristic.

4. An apparatus for indicating a physical characteristic along the length of a welding wire traveling in a given path, said apparatus comprising: an induction coil surrounding said path; a source of AC current connected across said coil, a first circuit to measure the inductive reactance of said coil; a second circuit to compare said measured inductive reactance with a reference inductive reactance; and, an output device responsive to a difference between said measured inductive reactance and said reference inductive reactance to indicate the magnitude of said physical characteristic, wherein said welding wire is a cored wire with an outer sheath and said physical characteristic is the wall thickness of said sheath.

5. An apparatus as defined in claim 4 wherein said reference inductive reactance is the inductive reactance across a reference coil with a selected reference core fixed in said reference coil.

6. An apparatus as defined in claim 5 wherein said reference core is a piece of welding wire having a desired magnitude for said physical characteristic.

7. An apparatus as defined in claim 6 wherein said reference core is a cored wire with an outer sheath having a desired wall thickness.

8. An apparatus as defined in claim 5 wherein said reference core is a cored wire with an outer sheath having a desired wall thickness.

9. An apparatus as defined in claim 4 wherein said output device has a visual mechanism to display said magnitude of said physical characteristic.

10. An apparatus for indicating a physical characteristic along the length of a welding wire traveling in a given path, said apparatus comprising: an induction coil surrounding said path; a source of AC current connected across said coil, a first circuit to measure the inductive reactance of said coil; a second circuit to compare said measured inductive reactance with a reference inductive reactance; and, an output device responsive to a difference between said measured inductive reactance and said reference inductive reactance to indicate the magnitude of said physical characteristic, wherein said reference inductive reactance is the inductive reactance across a reference coil with a selected reference core fixed in said reference coil, and wherein said reference core is a piece of welding wire having a desired magnitude for said physical characteristic.

11. An apparatus as defined in claim 10 wherein said reference core is a cored wire with an outer sheath having a desired wall thickness.

12. An apparatus as defined in claim 10 wherein said reference coil is connected in a bridge with said induction coil and driven mutually by said AC current.

13. An apparatus for indicating a physical characteristic along the length of a welding wire traveling in a given path, said apparatus comprising: an induction coil surrounding said path; a source of AC current connected across said coil, a first circuit to measure the inductive reactance of said coil; a second circuit to compare said measured inductive reactance with a reference inductive reactance; and, an output device responsive to a difference between said measured inductive reactance and said reference inductive reactance to indicate the magnitude of said physical characteristic; wherein said reference inductive reactance is the inductive reactance across a reference coil with a selected reference core fixed in said reference coil; wherein said reference coil is connected in a bridge with said induction coil and driven mutually by said AC current; and wherein said reference core is a piece of welding wire having a desired magnitude for said physical characteristic.

14. An apparatus as defined in claim 13 wherein said reference core is a cored wire with an outer sheath having a desired wall thickness.

15. An apparatus for indicating a physical characteristic along the length of a welding wire traveling in a given path, said apparatus comprising: an induction coil surrounding said path; a source of AC current connected across said coil, a first circuit to measure the inductive reactance of said coil; a second circuit to compare said measured inductive reactance with a reference inductive reactance; and, an output device responsive to a difference between said measured inductive reactance and said reference inductive reactance to indicate the magnitude of said physical characteristic; wherein said welding wire is a solid metal wire and said physical characteristic is the diameter of said wire.

16. An apparatus as defined in claim 15 wherein said reference inductive reactance is the inductive reactance across a reference coil with a selected reference core fixed in said reference coil.

17. An apparatus as defined in claim 16 wherein said reference core is a piece of welding wire having a desired magnitude for said physical characteristic.

18. An apparatus as defined in claim 17 wherein said reference core is a solid metal wire with a desired diameter.

19. An apparatus as defined in claim 15 wherein said output device has a visual mechanism to display said magnitude of said physical characteristic.

20. An apparatus for indicating the wall thickness of a cored welding wire traveling in a given path, said apparatus comprising: a first induction coil surrounding said path; a source of AC current connected across said coil; a second reference coil connected to said AC source; said second reference coil surrounding a fixed section of cored welding wire with a desired wall thickness; and, an output device indicating deviation of the wall thickness of said traveling wire from the wall thickness of said fixed section of wire by detecting the inductive reactance of said first coil compared to said second coil.

21. An apparatus as defined in claim 20 including an adjustable resistor in series with one of said coils to balance the inductance reactance of said coils.

22. An apparatus as defined in claim 21 wherein said adjustable resistor is in series with said reference coil.

23. An apparatus as defined in claim 22 wherein said output device includes a LVDT having a first input driven by said AC current signal, a second input with a signal having a waveform controlled by the magnitude of the difference between said inductive reactance and an output based upon a comparison of said signals at said first and second inputs.

24. An apparatus as defined in claim 22 wherein said first and second coils have substantially the same number of turns and the same lengths.

25. An apparatus as defined in claim 21 wherein said first and second coils have substantially the same number of turns and the same lengths.

26. An apparatus as defined in claim 21 wherein said output device includes a LVDT having a first input driven by said AC current signal, a second input with a signal having a waveform controlled by the magnitude of the difference between said inductive reactance and an output based upon a comparison of said signals at said first and second inputs.

27. An apparatus as defined in claim 20 wherein said output device includes a LVDT having a first input driven by said AC current signal, a second input with a signal having a waveform controlled by the magnitude of the difference between said inductive reactance and an output based upon a comparison of said signals at said first and second inputs.

28. An apparatus as defined in claim 27 wherein said first and second coils have substantially the same number of turns and the same lengths.

29. An apparatus as defined in claim 20 wherein said first and second coils have substantially the same number of turns and the same lengths.

30. An apparatus as defined in claim 29, wherein said length is less than 6 inches.

31. A method of measuring deviation of the wall thickness of a cored welding wire moving along a given path from a desired wall thickness, said method comprising:

(a) placing a coil around said path;

(b) energizing said coil with an AC current;

(b1) moving a cored welding wire through said coil along said path;

(c) measuring the inductive reactance of said coil as said cored welding electrode moves along said path;

(d) comparing said measured inductive reactance with a reference inductive reactance relating to said desired wall thickness; and, (e) providing an output based upon said comparison.

32. A method as defined in claim 31 wherein said reference inductive reactance is provided by a coil energized by said AC current and having a fixed reference core.

33. A method as defined in claim 32 wherein said reference core is a length of cored wire having the desired wall thickness.

34. A method as defined in claim 31 wherein said reference core is a length of cored wire having the desired wall thickness.

35. An apparatus for indicating a physical characteristic along the length of a welding wire traveling in a given path, said apparatus comprising: an induction coil surrounding said path with a length of less than 6 inches; a source of AC current connected across said coil, a first circuit to measure the inductive reactance of said coil; a second circuit to compare said measured inductive reactance with a reference inductive reactance; and, an output device responsive to a difference between said measured inductive reactance and said reference inductive reactance to indicate the magnitude of said physical characteristic, wherein said welding wire is a cored wire with an outer sheath and said physical characteristic is the wall thickness of said sheath.

36. An apparatus as defined in claim 35 wherein said reference inductive reactance is the inductive reactance across a reference coil with a selected reference core fixed in said reference coil.

37. An apparatus as defined in claim 36 wherein said reference coil has the same general length as said induction coil.

38. An apparatus as defined in claim 36 wherein said reference core is a piece of welding wire having a desired magnitude for said physical characteristic.

39. An apparatus as defined in claim 38 wherein said reference core is a cored wire with an outer sheath having a desired wall thickness.

* * * * *